United States Patent [19]

Shinn

[11] 4,455,040

[45] Jun. 19, 1984

[54] HIGH-PRESSURE WELLHEAD SEAL

[75] Inventor: Terry L. Shinn, Houston, Tex.

[73] Assignee: Smith International, Inc., Newport Beach, Calif.

[21] Appl. No.: 289,285

[22] Filed: Aug. 3, 1981

[51] Int. Cl.[3] ..... F16L 39/00; F16L 55/00; F16L 19/00

[52] U.S. Cl. ..... 285/142; 285/93; 285/338; 285/348; 285/DIG. 18; 277/236

[58] Field of Search ..... 285/140–143, 285/147, 348, DIG. 18, 338, 93; 277/236, 116.4, 116.6

[56] References Cited

U.S. PATENT DOCUMENTS

| | | | |
|---|---|---|---|
| 1,323,660 | 12/1919 | Thrift | 285/147 |
| 3,104,121 | 9/1963 | Nordin et al. | 285/DIG. 18 |
| 4,056,272 | 11/1977 | Morrill | 285/140 |
| 4,190,270 | 2/1980 | Vanderford | 285/142 |

*Primary Examiner*—Richard J. Scanlan, Jr.
*Attorney, Agent, or Firm*—Ned L. Conley; David Alan Rose; William E. Shull

[57] ABSTRACT

A tubing head, tubing head adapter and tubing hanger are sealed against annulus fluid or downhole pressure by an upper and a lower, pressure-energizing sealing assembly. The sealing assemblies are bi-directional, pressure-energizing and operate under working pressures of up to 30,000 psi. Each assembly consists of a metal seal ring made of highly elastic and ductile 316 stainless steel with a yield strength of approximately 30,000 psi, having a frustoconical shape, with the upper and lower tips of the cone enclosing an angle of approximately 28° in the prestressed state. In the axial direction, the seal ring engages a support ring on one end and a tubing hanger shoulder at the other end, both of which form inclines of 30° with the vertical (radial) plane. The support ring and the tubing hanger shoulders are made of materials having yield strengths of 50,000 psi and 75,000 psi, respectively. The preload applied to the seal assemblies is such that the seal ring plastically conforms to the harder surrounding surfaces and assumes a cone taper angle of 30°, in conformity with the mating support ring and tubing hanger shoulder. Thereafter, working pressure applied from either axial direction will be resolved along the incline of interacting surfaces into radial components which further enhance the sealing pressure along the inner and outer sealing surfaces. Because of this bidirectional pressure-enhancement, both seal assemblies may be tested through the application of test pressure from one common test port located between the two assemblies.

35 Claims, 3 Drawing Figures

HIGH-PRESSURE WELLHEAD SEAL

TECHNICAL FIELD

This invention relates to high-pressure oilfield wellhead equipment and more particularly to seals for sealing between wellhead apparatus for withstanding pressures in the range to 30,000 psi.

BACKGROUND ART

One of the principal problems encountered in the drilling of, and production from, deep wells, is the high pressure found in these formations. Modern deep gas wells are known to operate at bottom hole pressures of up to 30,000 psi. Pressures of magnitudes in excess of 20,000 psi present a set of qualitatively different engineering problems for wellhead seal design. In addition to the inherent problem of sealing with minimal leakage, high bottom hole temperatures and corrosive gases compound the high pressure sealing problem. Because of the depths involved and the complexity of production equipment, equipment for these ultrahigh pressures must be designed such that it can be tested after being set in place prior to actual production. Improper seating must be detected and corrected at a stage when dismantling can still be done relatively quickly and inexpensively.

In the prior art, Belleville seals are commonly known to operate satisfactorily at moderate pressures. However, even at moderate pressures, Belleville seals are generally not elastic enough to seal against substantial pressure fluctuation or pressure reversal without loss of the low pressure seal. They will therefore not permit the application of test pressure from a direction opposite the operating pressure.

When installing a casing hanger, once the casing hanger is landed in the hole, the seals are generally set by the weight of the casing string suspended from the casing hanger. When the next head above the hanger is to be installed, the integrity of the intermediate seals between the hanger and head must be tested. Most prior art designs do not possess the capability of pressure testing from a direction other than the working pressure side. In applying test pressure on unidirectional metal seals, mandrel and bore are frequently damaged since Belleville seals will "coin" or dig into the surface thus rendering the seal inoperative under pressure fluctuations. To achieve both a low pressure (setting) seal and high pressure (working pressure) seal, many prior art designs employ a composite elastomeric/metal seal or a set of Chevron elastomeric packings in addition to the main metal seal between which the test pressure for the metal seal is applied. Sour gas environments, however, high pressures and operating temperatures of up to 350° F. severely restrict the applicability of such elastomeric seals or render them one-time test seals only.

In related prior art, softer metals have often been used for frustoconically tapered seals. For example, U.S. Pat. No. 1,323,660 to H. C. Thrift discloses a well capping device consisting of a sleeve adapted to fit over the casing. The sleeve is pressed against the casing by means of wedge-shaped slips whose inner faces are serrated, forming arcuate teeth for engaging the casing wall. Between the wedge-shaped slips and a flared collar at the bottom of the sleeve are positioned several frustoconically shaped rings made of very soft metal, such as lead. In case of an impending blowout, the casing pressure will cause the conical ring to be compressed between the slips and the collar. Being of soft metal, the rings will be flattened, thereby forming a close fitting joint between the casing and the sleeve. Lead, however, is a metal practically devoid of tenacity, ductility and elasticity and would therefore not be capable of sustaining much circumferential stress and elongation and would not return toward its original shape upon release of the load. Unless the initial clearance between such a lead seal ring and the inner and outer surface with which it is to seal closely approaches zero, the lead ring will fracture in hoop tension upon imposition of load. In order for sealing pressure enhancement along the radial surfaces to come into play, the hoop stresses must be able to elastically expand the rings in a radial direction.

U.S. Pat. No. 2,090,956 to Wheeler teaches the use of a series of frustoconically shaped packing rings, made not of metal, but of some porous material. These rings may be compressed longitudinally between similarly shaped adapter rings. Between the bevelled faces of the adapter rings, the soft packing rings become flattened and radially pressed against the sealing surfaces.

The downhole packer disclosed in U.S. Pat. No. 2,120,982 to Layne uses a lead sleeve to contact the inside diameter of a concentric casing string. An alternative embodiment teaches the use of interlocking frustoconical wedge rings made of lead which are compressed and enhance the sealing contact between the inner and outer diameter surfaces when loaded by the make-up pressure supplied by screwing together the liner and casing. There is a substantial gap, however, between liner and casing such that the lead wedge must become outwardly flared for sealing to take place. These wedges then act more in the fashion of a lip seal and are therefore strictly undirectional seals.

U.S. Pat. No. 2,135,583 to Layne describes a combination packer which uses a soft lead seal to back up a fabric or a second soft metal packing for increased reliability. The packing is set by the weight of the string of pipe and compressed to a generally frustoconical shape.

U.S. Pat. No. 3,347,319 to Littlejohn pertains to methods and apparatus for hanging large diameter casing. An interior hanging ring of generally triangular cross section is welded to the interior of the larger string of casing. A matingly tapered exterior hanging ring of generally frustoconical shape is affixed to the exterior of the smaller length of casing. The two main purposes mentioned in the patent for this metal-to-metal seal are to afford a projection on which the succeeding length of casing may be hung and to reinforce the casing to prevent its failure by outward pressure. No sealing function seems to be intended or achieved.

U.S. Pat. No. 3,436,084 to Courter discloses a packer with an elastomeric packer element which is contained to substantially eliminate the flow of the elastomeric material under pressure. A series of arcuate segments along one circumferential edge of the deformable packing element are made by spaced vertical cuts. The segments have metal or hard tough resin faced plates molded onto their mating vertical end faces and connecting reinforcing slideable pins through the face plates prevent the packing element from flowing longitudinally under pressure when the packing element itself is forced outwardly.

U.S. Pat. No 3,797,864 to Hynes et al. describes a well casing hanger with a seal deformable into sealing engagement with opposed cylindrical walls of the casing hanger body and another body upon actual compression of the seal. The seal is a compound of a cylindrical elastomeric body and metallic skirt or end rings on the corners of the elastomeric element. The end rings are provided with marginal lips which are deformed oppositely into metal-to-metal sealing engagement with the cylindrical walls. The metal rings thus appear to be acting primarily as an anti-extrusion device for the elastomeric element.

U.S. Pat. No. 3,902,743 to Martin pertains to a retractable support shoulder arrangement providing a split ring seat that facilitates running maximum size downhole tools through the upper access opening of the casinghead during drilling operations. In its extended position the split ring seat element provides an essentially full circle seating surface for firmly and properly supporting a casing hanger or other device in the head. In that position it presents generally frustoconically tapered seating surfaces which do not appear to have any sealing function.

The present invention overcomes the problems and deficiencies of the prior art and specifically permits a bidirectional application of pressure whereby the seal may be tested from a direction opposite the operating pressure. Other advantages of the present invention will be apparent from the following description.

DISCLOSURE OF INVENTION

In a tubing hanger a metal seal ring is inserted between a support ring and the mandrel shoulder for sealing against extremely high pressures of up to 30,000 psi from either direction. In the preferred configuration an upper and a lower seal are installed in the annulus between the tubing hanger, casing hanger or mandrel and the tubing head or casing head. The make-up pressure or setting pressure for the lower seal is provided by the tubing or casing weight transmitted by the support ring onto the seal ring. In the preassembled position, the axial (vertically tapered) bearing surfaces of the seal ring form a 28° angle with the vertical (radial) seal faces of the seal ring. In the assembled position, that angle; and hence the bearing surfaces of the seal ring, will conform to the corresponding mating surfaces on the tubing hanger and the support ring, which form a 30° angle with the vertical plane.

When preloads or working pressures are applied to the seal assemblies, these pressures act on the respective seal rings to impose thrust loads, so that resultant forces on the seal faces act radially (inwardly as well as outwardly). The load-enhanced reaction forces normal to the bearing surfaces thus generate radial components which provide substantially equal contact pressure against the inner diameter bearing areas and the outer diameter bearing areas. In this fashion, the annulus is sealed equally well against pressure from the top and the bottom. It is, therefore, possible to test the entire sealing arrangement prior to production by applying a test pressure of working magnitude in substantially the opposite direction as the operating pressures.

BRIEF DESCRIPTION OF THE DRAWINGS

For a detailed description of a preferred embodiment of the invention, reference will now be made to the accompanying drawings wherein.

BEST MODE OF CARRYING OUT THE INVENTION

Figure 1:
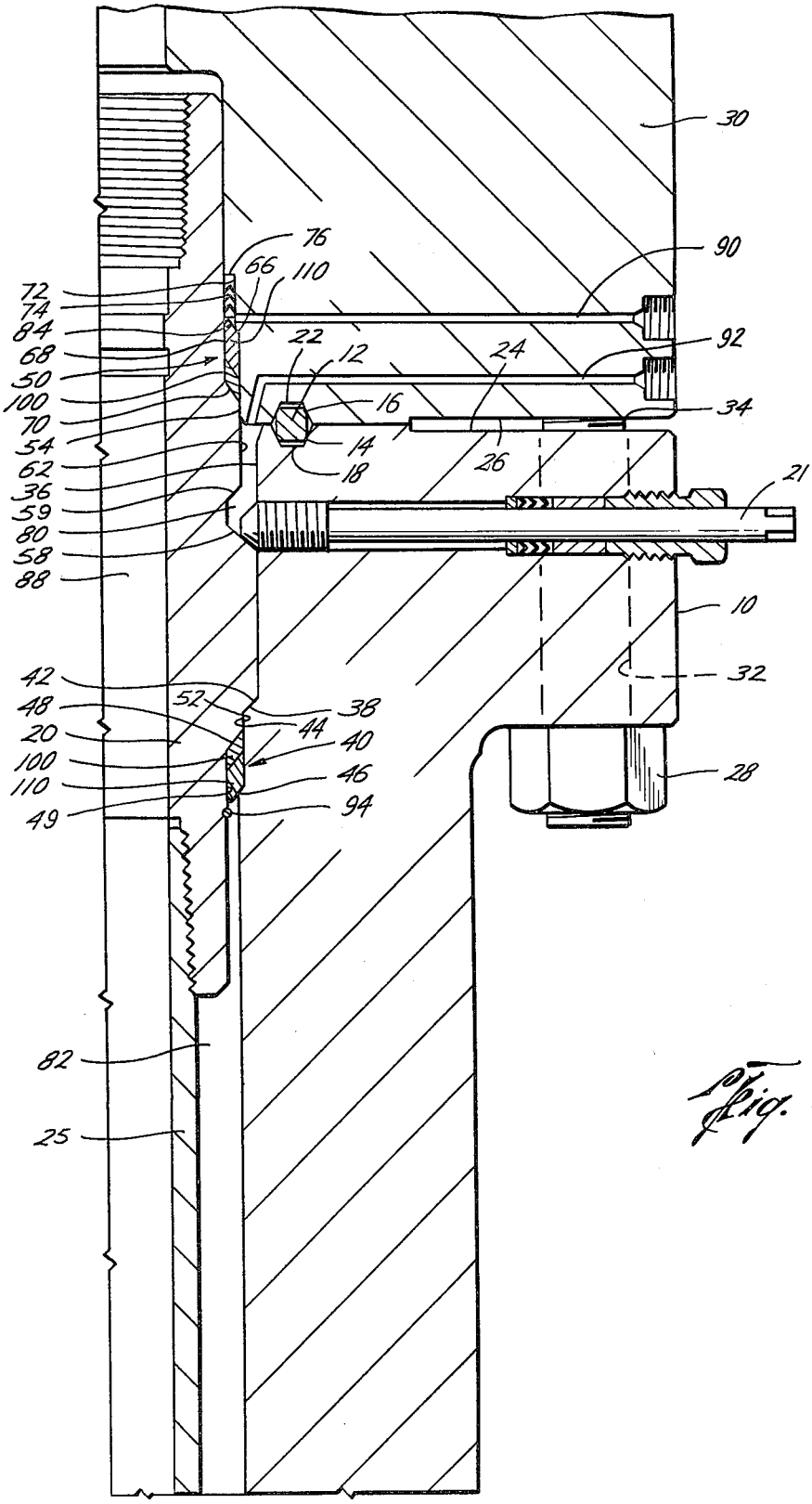
FIG. 1 is a cross-sectional view of a typical environment of the seals of the present invention.

Referring initially to FIG. 1, there is illustrated a typical environment of the present invention. A wellhead or tubing head 10 is shown supporting a tubing hanger 20 which is retained in place by a tubing head adapter 30 and lock screws 21. The tubing head 10 and tubing hanger 20 are sealed against downhole pressure by sealing assembly 40, and tubing hanger 20 and tubing head adapter 30 are sealed against downhole pressure by sealing assembly 50. A metal gasket seal 12 sealingly engages the walls 14, 16 of annular grooves 18, 22 in the facing surfaces 24, 26 of tubing head 10 and tubing head adapter 30, respectively. Tubing head adapter bolts 28 pass through apertures 32 located around the periphery of tubing head 10 and are, for example, threadedly engaged with tubing head adapter 30 at 34. The present invention, as shown in FIG. 1, relates to the use of the present invention in a single concentric string completion as generally shown and described at page 4909 of the 1980-81 composite Catalog of Oil Field Equipment and Services, incorporated by reference herein, but such invention may be applied to multiple parallel string completions as generally shown and described at page 4910 of the 1980-81 Composite Catalog of Oil Field Equipment and Services, incorporated by reference herein. It is understood that wellhead 10 (tubing head) surmounts and is attached to another wellhead (casing head) within which is suspended and sealed a string of pipe (casing) as shown in the above incorporated reference and that tubing pipe 25 of FIG. 1 together with the casing pipe will extend down into the wellbore, e.g. to the producing formations.

Tubing head 10 includes an inner counterbore 36 forming an upwardly facing and downwardly tapering frustoconical shoulder 38 for supporting engagement with downwardly facing and downwardly tapering annular frustoconical shoulder 42 on tubing hanger 20. Tubing hanger 20 suspends tubing 25 within the well by means of the supporting engagement of shoulder 38, 42 which ultimately limits the total amount of travel of tubing hanger 20 into tubing head 10.

Tubing head 10 includes a smaller diameter portion or sealing counterbore 44 disposed below frustoconical shoulder 38. Sealing counterbore 44 forms an upwardly facing and downwardly tapering frustoconical shoulder 46 for supporting sealing assembly 40. Downwardly facing frustoconical shoulder 42 on tubing hanger 20 includes an inner annular downwardly facing and tapering frustoconical actuator shoulder 48 having an outer diameter 52 dimensioned to be telescopically received within counterbore 44 of tubing head 10. Below lower seal assembly 40, tubing hanger 20 includes a retainer ring 94 along its outer circumference which limits the downward travel of seal assembly 40 while the hanger is being installed or removed.

Tubing head adapter 30 includes a reduced diameter portion or seal counterbore 54. The diameter of counterbore 54 is substantially the same as the diameter 52 of tubing hanger 20. Upon assembly as shown in FIG. 1, tubing hanger 20 includes an upwardly facing and upwardly tapered frustoconical shoulder 58 against which lock screws 21 can be applied. Above shoulder 58 tubing hanger 20 is provided with an annular surface 62 having a portion opposite counterbore 36 of tubing head 10.

Seal counterbore 54 forms a downwardly facing and upwardly tapering frustoconical shoulder 66 engaging upper seal assembly 50. Tubing hanger 20 includes a reduced sealing diameter or support surface 68 above surface 62 and having a smaller diameter within surface 62. Support surface 68 has a smooth finish, e.g., RMS 32 or better, typically ground to achieve that effect. Support surface 68 forms an upwardly facing and upwardly tapering frustoconical shoulder 70 for engaging seal assembly 50. Thus, seal assembly 50 is housed between the wall of counterbore 54 of tubing head adapter 30 and support surface 68 of hanger 20 and between frustoconical shoulders 66, 70 of tubing head adapter 30 and hanger 20, respectively.

Tubing head adapter 30 includes a reduced diameter portion 72 having a diameter smaller than the inner diameter of sealing surface 54. If additional testing from above, i.e., in the direction of downhole pressure, is desired or required, an elastomeric or Chevron test packing 74 may be housed between the upper end 76 of reduced diameter portion 72 and the top of seal assembly 50.

Upon assembly, an annular area or annulus 80 is formed between tubing hanger 20 and tubing head 10. The lower portion of tubing hanger 20 and tubing string 25 form a lower annular area or annulus 82 with tubing head 10 and tubing string 25. A small annular space 84 is formed above seal assembly 50, e.g., between test packing 74 and upper support ring 110. Bottom hole pressure pressurizes the lower annulus 82 below seal assembly 40 and pressurizes upper annular area 84 through the flow bore 88 of tubing hanger 20 and past test packing 74 at the upper end of hanger 20. One of the functions of seal assemblies 40, 50 is to isolate annulus 80 from downhole pressure.

One of the principal objects of the present invention is to test seal assemblies 40, 50. An upper radial test port 90 and a lower radial test port 92 are provided in tubing head adapter 30 for the application of test pressures to seal assemblies 50 and 40, respectively. To permit such pressure tests on upper seal assembly 50, test packing 74, disposed in reduced diameter portion 72 in tubing head adapter 30 above seal assembly 50, permits the application of test pressure through upper test port 90 to test seal assembly 50 from above. Test port 92 permits the application of test pressure to test both seal assembly 40 and upper seal assembly 50 at the same time. Because of the bidirectional sealing capabilities of the seal assemblies of the present invention, the application of test pressure need not be from the same direction as the setting load (and as provided through test port 90 upon upper seal assembly 50), but may be achieved through one test port 92 for both upper and lower seal assemblies 50, 40 respectively (thereby testing upper seal assembly 50 in a direction opposite the setting pressure).

Figure 2:
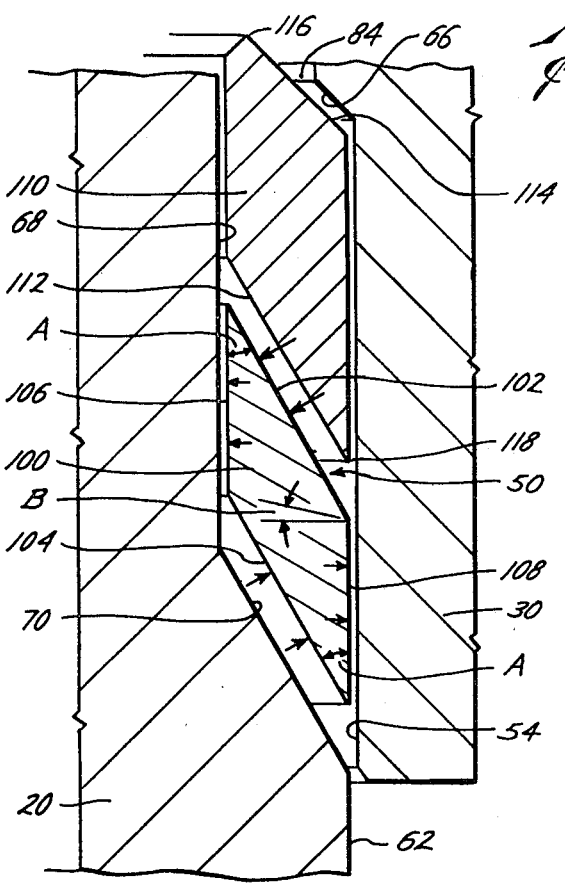
FIG. 2 is an enlarged cross-sectional view of the seal ring of the present invention.

Referring now to FIG. 2 for a detailed description of seal assembly 50, seal assembly 50 is shown in an enlarged view prior to the tightening of tubing head adapter 30 onto tubing head 10. Since lower sealing assembly 40 is identical in design and function to sealing assembly 50 (merely installed in an inverted fashion), the description of the functional and structural details of upper sealing assembly 50 shown in FIG. 2 applies by analogy to lower sealing assembly 40, which, for that reason, will not be described in further detail.

Sealing assembly 50 includes seal ring 100 and support ring 110. As previously described, seal assembly 50 is disposed on upwardly facing and upwardly tapering frustoconical shoulder 70 of tubing hanger 20. Seal assembly 50 is located radially in both counterbore 54 of wellhead flange 30 and support surface 68 of tubing hanger 20. Seal ring 100 rests on frustoconical shoulder 70 of hanger 20, and support ring 110 engages downwardly facing and upwardly tapering frustoconical shoulder 66 of tubing head adapter 30.

To assist in the description and operation of seal ring 100, each of its four surfaces has been labelled, i.e., upper bearing surface 102, lower bearing surface 104, inner bearing surface 106 and outer bearing surface 108. Upper bearing surface 102 engages support ring 110, and lower bearing surface 104 engages upwardly facing frustoconical shoulder 70 of hanger 20. Inner bearing surface 106 engages the wall of support surface 68 of hanger 20, and outer bearing surface 108 engages the wall of counterbore 54 of tubing head adapter 30.

The cross section of seal ring 100 as shown in FIG. 2, is of generally diamond shape forming a parallelogram. The angles, when seal ring 100 is shown in cross section, formed by surfaces 102, 106 and surfaces 104, 108, labelled as angles A, are preferably 28° in the prestressed state. Angle B will be formed if a line were drawn from the point of intersection of surfaces 102, 108 to a point of intersection of surfaces 104, 106 and a second line perpendicular to surface 108 through the point of intersection of surfaces 102, 108. That angle B is preferably 17°-20° in the prestressed state. The taper on upwardly facing frustoconical shoulder 70 preferably forms an angle of 150° with the wall of support surface 68.

Support ring 110 has a lower downwardly facing frustoconical surface 112 cooperable with the upper frustoconical bearing surface 102 of seal ring 100. Support ring 110 has an upwardly facing frustoconical surface 114 for cooperative engagement with downwardly facing frustoconical shoulder 66 on tubing head adapter 30.

Upon assembly of tubing head adapter 30 to tubing head 10, the thrust load applied by downwardly facing frustoconical shoulder 66 on support ring 110 provides a setting load normal to bearing area 102 of seal ring 100. This normal force (shown by arrows) causes a reaction force (shown by arrows) from upwardly facing frustoconical shoulder 70 on hanger 20 normal to bearing area 104 of seal ring 100. The forces acting on ring 110 and shoulder 70 normal to bearing areas 102 and 104, respectively, of seal ring 100 have inner and outer radial components (shown by arrows) which provide substantially equal contact pressure from inner bearing area 106 against the wall of support surface 68 of hanger 20 and from outer bearing area 108 against the wall of counterbore 54 of tubing head adapter 30.

Conversely, after setting seal assembly 50, the application of test pressure through test port 92 to lower bearing surface 104 causes a thrust load normal to bearing area 104 which in turn causes support ring 110 to apply a reaction force normal to bearing area 102. The radial components resulting from these forces normal to bearing areas 102 and 104 are once again enhancing, in substantially equal proportions, the contact pressures upon the wall of support surface 68 of tubing hanger 20 and upon the wall of counterbore 54 of tubing head adapter 30. Thus, seal 100 may be actuated bidirectionally, either from the top or from the bottom, to provide a substantially equal contact pressure on the inner and outer diameter bearing areas 106 and 108, respectively. If downhole pressure is applied to annulus 84 or if test pressure is applied through test port 90, seal ring 100 will be energized from the upper axial direction.

Conventional metal seal rings are very thin washer-type frustoconical rings. While in the preferred embodiment shown in FIG. 2, the angle B, which controls the thickness of the seal ring 100, is considerably larger for conventional seals. Conventional washer-type or Belleville seal rings become flattened in the axial direction when setting loads or work loads are applied. Conventional seal rings are also usually employed without matingly tapered support rings. Sandwiched between generally flat load transmitting surfaces, the inside diameter of such thin rings will decrease and their outside diameter increase, which leads to "coining" in the hanger or the body and causes plastic deformation along the radial sealing surfaces of the Belleville washers. This damage will lead to loss of the low pressure seal when the peak load is alternatingly increased or decreased under pressure fluctuations.

The bidirectional seal ring 100 of the present invention, on the other hand, is a pressure energizing seal. It is designed such that all the plastic deformation that is ever going to occur is undergone at the time of setting the seal. The seal ring 100 itself must therefore be extremely well contained and the contact stresses generated, as well as the yield strength of the materials used so chosen, that there is no more plastic deformation throughout the working pressure range even though the latter may be applied from either direction.

The crucial parameters for achieving bidirectional sealing and ultrahigh pressure, as well as continuing low pressure seals under pressure cycling, are (i) the thickness of seal ring 100 (ii) the taper angle of the frustoconical axial bearing surfaces of seal ring 100, and (iii) the relative yield strength of the materials interacting at the various bearing surfaces or seal faces of seal rings 100, support rings 110, and shoulder 66, 70, 48, 46, respectively.

The thickness of seal ring 100 is controlled by angle B. Thickness is a function of the working pressure encountered and the contact stresses generated by it. The hoop stresses induced by the setting load (regardless of the addition thereto or subtraction therefrom of work loads) must be within a region just greater than the yield strength of the seal ring material but always less than the ultimate strength which would cause the rings to fracture and also less than any stress which would cause damage in the mating pieces. The shoulder areas 66, 70 and 46, 48 are sized so as to give the right amount of load necessary to set the seal (which is, generally speaking, something less than the tubing weight and may be appropriately sized with the help of lock screws 21). The setting load, in turn, must be higher than any load that pressure would cause from the opposite direction and so high that all plastic deformations happen during the setting stage. Elastic and plastic deformation of the support ring 110 supported on shoulder 46 in tubing head 10 limits the total amount of preload that can be applied to seal 100.

Figure 3:
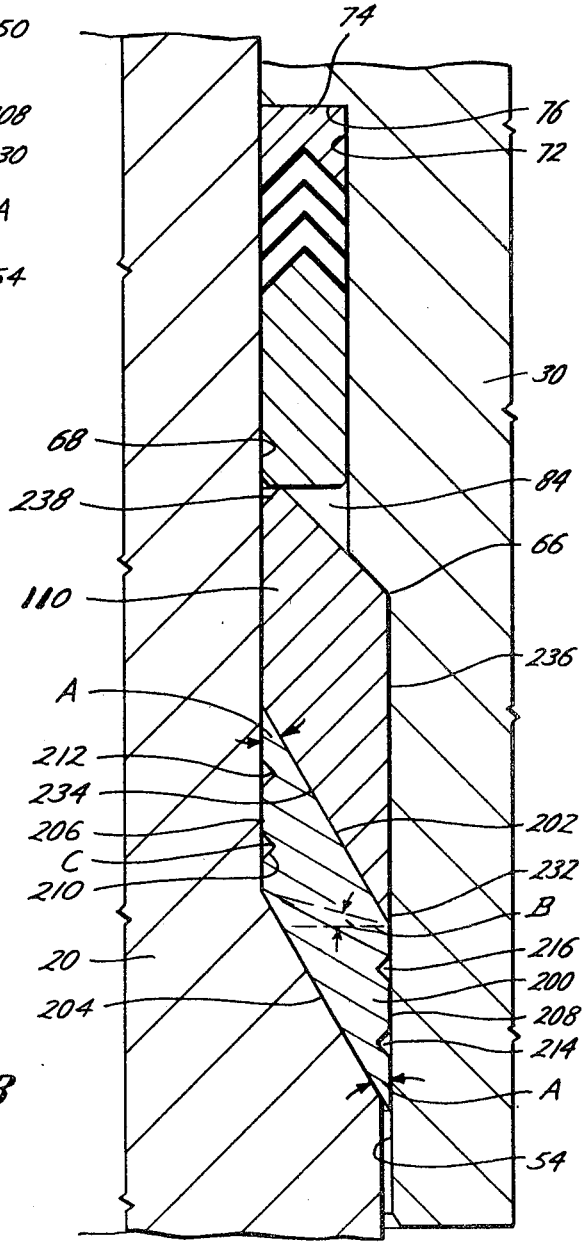
FIG. 3 is a cross-sectional view of another embodiment of the present invention.

The geometrical design chosen for the preferred embodiment of the present invention encompasses a taper angle (as defined by angle A) of approximately 30° after setting (as shown in FIG. 3). For seal rings of diameters between 4"–8" and of up to ½" cross sections, angle A will generate the right additional radial components from any axial work loads which will ensure total (radial) seal face stresses of above yield strength limits for the seal ring and below the yield strength limits of the mandrel or tubing head surfaces.

In the preferred embodiment of the present invention, seal ring 100 is made of 316 stainless steel annealed, having a yield strength in the 30,000 to 35,000 psi range. Support ring 110 is made of an alloy material or carbon steel, having a yield strength of approximately 50,000 psi. The materials used for tubing head 10, tubing hanger 20 and tubing head adapter 30 are, for sour gas and for pressures above 10,000 psi, generally in the 210–235 Brinell hardness range with a yield strength of approximately 75,000 psi. The sealing material must be soft enough to yield so as to conform to any irregularities in hanger support surfaces 49, 68 and shoulders 48, 70, yet strong enough to support the loads encountered. With the 316 stainless steel material chosen for seal ring 100 of the present invention, the working pressure of 30,000 psi is at the yield strength limit. Hence, a well-contained seal ring will plastically conform to any irregularities in the (harder) support ring or shoulder surfaces. It will retain, however, a substantial amount of elasticity so that additional loads will not cause any further plastic deformations, while also not causing any permanent damage in the support rings or shoulder. Additional loads even from a direction opposite the setting load will, due to the symmetrical geometry of the seal ring/support ring shoulder interfaces, generate additional radial components so as not to relieve sealing contact even in that situation. The seal ring material, i.e. 316 stainless steel, possesses sufficient elastic memory to revert to substantially a prestressed shape such that removal of the seal assembly is possible without damage to the bore. Although it is intended that the tubing hanger remain in place for years, it is of great importance to be able to disassemble the wellhead if and when necessary without destroying mating sealing surfaces.

The material used for the seal ring, then, must have a thermal expansion coefficient that is approximately equal to that of the support ring and head and hanger materials in order to avoid either overloading or annular gaps within the seal assembly under elevated working temperatures. The seal ring 100 must further be made of a highly elastic material since the seal ring is subjected to very high hoop stresses which the material must be able to sustain in order to maintain sealing contact under extremely high pressure conditions. When test pressure is applied through test port 92, for example, tubing head 10 will be expanded radially outwardly (and therefore away from sealing surfaces 108) under the pressure maintained within annulus 80, while at the same time tubing hanger 20 is compressed in a radially inwardly direction (and therefore away from sealing surfaces 106) under the same pressure within annulus 80. The seal ring 100 must be able to keep up with those movements and maintain sealing contact along faces 106,108. Inelastic, highly plastic material such as lead, for example, while perhaps suited to withstand the purely compressive axial loads, would not possess the tensile strength and ductility required to undergo the necessary radial expansion. High elasticity of seal ring material is also necessitated by the fact that pressure fluctuations and removals of seal assemblies 40,50 must be possible without damage to the bore.

Referring now to FIG. 3, additional features and modifications to the preferred embodiment of FIGS. 1 and 2 have been shown. Those elements of FIG. 3 common to the preferred embodiment shown in FIGS. 1 and 2 bear the same reference numerals. As shown in FIG. 3, a modified seal ring 200 is shown. Seal ring 200 includes an upper bearing surface 202, a lower bearing surface 204, an inner bearing surface 206 and an outer bearing surface 208. Upper bearing surface 202 engages support ring 110 and lower bearing surface 204 engages upwardly facing frustoconical shoulder 70 of hanger 20. Inner bearing surface 206 engages the wall of support surface 68 of hanger 20 and the outer bearing surface 208 engages the wall of counterbore 54 of tubing head adapter 30.

The cross section of seal ring 200 as shown in FIG. 3 is again that of a general diamond shape forming a parallelogram as also shown in FIG. 2. The angles, when seal ring 200 is shown in the assembled state of FIG. 3, formed by surfaces 202, 206 and surfaces 204, 208, labeled again as angles A, are now conforming angles of 30°, as are the mating angles of contact surfaces 70 and 112 of hanger 20 and support ring 110, respectively. As described above, the seal face angle between bearing surfaces 104, 108, 204, and 208 of seal rings 100, 200, respectively, is only approximately 28° in the prestressed state. When the setting load is applied, however, the hoop stresses induced in seal rings 100, 200 will conform angle A to the 30° geometry of support ring 110 and contact shoulder 70 of tubing hanger 20.

Angle B is formed by a line drawn from the point of intersection of surfaces 202, 208 to the point of intersection of surfaces 204, 206 and a second line drawn perpendicular to surface 208 through the point of intersection of surfaces 202, 208. That angle B is preferably 15° in the assembled state depicted in FIG. 3.

The principal difference between seal ring 100 of the preferred embodiment and seal ring 200 is that inner bearing surface 206 includes two (or more) triangular cross-sectioned grooves 210, 212 and outer bearing surface 208 includes two (or more) triangular cross-sectioned grooves 214, 216. Grooves 210, 212 and 214, 216 reduce the amount of contact area with the wall of support surface 68 of hanger 20 and the wall of conterbore 54 of tubing head adapter 30 along inner bearing surface 206 and outer bearing surface 208, respectively. The reduction of contact area leads to earlier plastic deformations in the low pressure range. Such reduction in contact area results in a very high initial contact stress, thus enhancing the low pressure seal. As pressure increases, the apexes, C, of triangular grooves 210, 212 and 214, 216 become depressed and widen, thus adding some of the additional contact area necessary to insure that the peak contact stresses do not exceed the permissible design limit.

While a preferred embodiment of the invention has been shown and described, other modifications thereof can be made by one skilled in the art without departing from the spirit of the invention.

What is claimed is:

1. A double-acting, pressure-enhancing metal seal ring for sealing engagement between an outer cylindrical wall surface of an inner tubular member and an inner cylindrical wall surface of an outer tubular member concentrically disposed around such inner tubular member in an annular space bounded from above and below by substantially parallel, tapered upper and lower compression surfaces, one of such compression surfaces being axially movable toward the other for compressing the seal ring therebetween, comprising:

a body having a cross section of parallelogram shape, said cross section having inner and outer sealing surfaces adjacent such outer and inner cylindrical wall surfaces, respectively, and upper and lower bearing surfaces adjacent such upper and lower compression surfaces, respectively, said upper and lower bearing surfaces being of slightly steeper taper than such adjacent compression surfaces;

said inner and outer sealing surfaces being forced radially inwardly and outwardly into sealing engagement with said outer and inner cylindrical wells, respectively, when such compression surfaces are forced toward each other and said upper and lower bearing surfaces are rotated thereby into flush conformity with the taper of such adjacent compression surfaces;

said body having a high axial thickness to radial width ratio such that the cone angle of said cross sectional shape of said body remains substantially the same when said seal ring is subjected to axial compression loads; and said body being made of a highly elastic and ductile metal.

2. The seal ring of claim 1 wherein said elastic metal includes 316 stainless steel.

3. The seal ring of claim 1 wherein said elastic metal includes metals having a yield strength of the same order of magnitude as the pressure to be contained.

4. The seal ring of claim 1 wherein said inner and outer sealing surfaces further includes at least one annular groove in each of said sealing surfaces for controlling contact stress between said sealing surfaces and such cylindrical wall surfaces.

5. The seal ring of claim 1 wherein said cone angle enclosed between said outer sealing surface and said lower bearing surface is approximately 28° in the prestressed state and such adjacent compression surface makes approximately a 30° angle with the vertical.

6. A double-acting, pressure-enhancing metal seal assembly, comprising:

a first cylindrical metal pressure vessel;

a second cylindrical metal pressure vessel concentrically disposed within said first pressure vessel to form an annular space;

a metal seal ring disposed in said annular space and having a cross section of parallelogram shape, said cross section having an inner and outer sealing surface substantially parallel to the walls of said vessels and an upper and a lower tapered bearing surface, a high axial thickness to radial width ratio such that the cone angles of said cross sectional shape remain substantially the same when said seal ring is subjected to axial compression loads, and said seal ring being made of a highly elastic and ductile metal;

first annular compression means disposed within said annular space having a first tapered compression surface for engaging one of said bearing surfaces of said metal seal ring;

second annular compression means disposed within said annular space having a second tapered compression surface for engaging the other of said bearing surfaces of said metal seal ring;

said first and second compression means being movable toward each other for compressing said seal ring therebetween;

said upper and lower bearing surfaces having a taper of the order of 2° steeper in the unstressed state than the taper of said first and second compression surfaces; and said inner and outer sealing surfaces being forced radially into sealing engagement with such walls of said vessels when said compression surfaces are actuated and said upper and lower bearing surfaces are rotated into flush abutting contact with the respective compression surfaces.

7. A double-acting, pressure-enhancing metal seal assembly, comprising:

a first cylindrical metal pressure vessel;

a second cylindrical metal pressure vessel concentrically disposed within said first pressure vessel to form an annular space;

a metal seal ring disposed in said annular space and having a cross section of parallelogram shape, said cross section having an inner and an outer sealing surface and an upper and a lower bearing surface, a high axial thickness to radial width ratio such that the cone angles of said cross sectional shape remain substantially the same when said seal ring is subjected to axial compression loads, and said seal ring being made of a highly elastic and ductile metal;

first annular compression means disposed within said annular space for engaging one of said bearing surfaces of said metal seal ring; and second annular compression means disposed within said annular space for engaging the other of said bearing surfaces of said metal seal ring, said first annular compression means including a metal support ring, said metal support having a generally trapezoidal cross section with inner and outer radial surfaces and upper and lower load transducing surfaces, whereby one of said load transducing surfaces engages one of said load bearing surfaces of said seal ring, and wherein said seal ring engaging load transducing surface and said outer radial surface of said support ring enclose an angle of approximately 30°, said support ring further being made of a material with a yield strength greater than the yield strength of said seal ring.

8. The seal assembly of claim 7 wherein said metal support ring has an axial thickness at least as great as the radial width of said support ring.

9. The seal assembly of claim 7 wherein said first annular compression means further includes a pressure transducing shoulder within said annular space, said shoulder being connected to one of said cylindrical pressure vessels and engaging the other of said load transducing surfaces of said support ring.

10. The seal assembly of claim 9 wherein said second annular compression means further includes a pressure transducing shoulder within said annular space, said shoulder being connected to the other of said cylindrical pressure vessels.

11. The seal assembly of claim 10 wherein said shoulders are made of a material having a yield strength greater than the yield strength of said support ring.

12. The seal assembly of claim 7 wherein said material of said support ring includes steel having a yield strength of at least 50,000 psi.

13. The seal assembly of claim 11 wherein said material of said shoulders and said pressure vessels includes steel having a yield strength of at least 70,000 psi.

14. The seal assembly of claim 6 wherein said seal ring is made of 316 stainless steel.

15. The seal assembly of claim 6 wherein said seal ring is made of a metal having a yield strength of the same order of magnitude as the pressure to be contained.

16. The seal assembly of claim 6 wherein said inner and outer sealing surfaces of said seal ring further include at least one annular groove in each of said sealing surfaces for controlling contact stress between said sealing surfaces and such walls of said vessels.

17. The seal assembly of claim 6 wherein said outer sealing surface and said lower bearing surface of said seal ring enclose an angle of approximately 28° in the prestressed state and the adjacent compression surface encloses an angle between it and the wall of the pressure vessel, adjacent said 28° angle, of approximately 30°.

18. A double-acting, pressure-enhancing metal seal assembly, comprising:

a first cylindrical metal pressure vessel;

a second cylindrical metal pressure vessel concentrically disposed within said first pressure vessel and forming an annular space therebetween;

a first metal seal ring disposed in said annular space and having a cross section of parallelogram shape, said cross section having an inner and an outer sealing surface and an upper and a lower bearing surface, a high axial thickness to radial width ratio such that the cone angles of said cross sectional shape remains substantially the same when said seal ring is subjected to axial compression loads, and said seal ring being made of highly elastic and ductile metal;

first annular compression means disposed within said annular space for engaging one of the bearing surfaces of said first metal seal ring;

second annular compression means disposed within said annular space for engaging the other of said bearing surfaces of said metal seal ring;

a second metal seal ring substantially identical to said first metal seal ring;

third annular compression means disposed within said annular space and axially below said second compression means for engaging one of the bearing surfaces of said second metal seal ring; and fourth annular compression means disposed within said annular space and axially below said third compression means for engaging the other of said bearing surfaces of said metal seal ring.

19. The seal assembly of claim 18 further comprising a test port through said first pressure vessel for introducing test fluid into said annular space between said second and said third annular compression means.

20. The seal assembly of claim 18 wherein both said first and said third annular compression means include a metal support ring, said metal support ring being disposed in said annular space and said metal ring having a generally trapezoidal cross section having inner and outer radial surfaces and upper and lower load transducing surfaces, whereby one of said load transducing surfaces engages one of said load bearing surfaces of one of said seal ring, and wherein said seal ring engaging load transducing surface and said outer radial surface of said support ring enclose an angle of approximately 30°, said support ring further being made of a material with a yield strength greater than the yield strength of said seal rings.

21. The seal assembly of claim 20 wherein said metal support rings further possess an axial thickness at least as great as the radial width of said support rings.

22. The seal assembly of claim 20 wherein said first and said third annular compression means further includes a pressure transducing shoulder within said annular space, said shoulder being connected to one of said cylindrical pressure vessels and engaging the other of said load transducing surfaces of said seal rings.

23. The seal assembly of claim 22 wherein said second and said fourth annular compression means further includes a pressure transducing shoulder within said annular space, said shoulder being connected to the other of said cylindrical pressure vessels.

24. The seal assembly of claim 23 wherein said shoulders are made of a material having a yield strength greater than the yield strength of said support rings.

25. The seal assembly of claim 20 wherein said material of said support ring includes steel having a yield strength of at least 50,000 psi.

26. The seal assembly of claim 24 wherein said material of said shoulders includes steel having a yield strength of at least 70,000 psi.

27. The seal assembly of claim 20 wherein said seal rings are made of 316 stainless steel.

28. The seal assembly of claim 20 wherein said seal rings are made of a metal having a yield strength of the same order of magnitude as the pressure to be contained.

29. The seal assembly of claim 20 wherein said inner and outer sealing surfaces of said seal ring further include at least one annular groove in each of said surfaces.

30. The seal assembly of claim 20 wherein said outer sealing surface and said lower bearing surface of said seal ring enclose an angle of approximately 28° in the prestressed state.

31. A metal seal ring for sealing an annulus between inner and outer vertical annular surfaces enclosed from above and below by tapered, substantially parallel upper and lower compression surfaces and subjected to upper and lower axial forces, one of such compression surfaces being movable axially toward the other for compressing the seal ring therebetween, comprising:

a cross section shaped like a parallelogram;

an upper annular frustoconical bearing surface adjacent such upper compression surface, for receiving such upper axial force;

a lower annular frustoconical bearing surface adjacent such lower compression surface for receiving such lower axial force;

said bearing surfaces being about 2° steeper in taper than such adjacent compression surfaces in the unstressed state;

an inner annular sealing contact surface adapted for sealingly engaging such inner vertical annular surface;

an outer annular sealing contact surface adapted for sealingly engaging such outer vertical annular surface;

said inner annular sealing contact surface sealingly engaging such inner vertical annular surface and said outer annular sealing contact surface sealingly engaging such outer vertical annular surface with substantially equal sealing contact upon the application of such upper axial force on said upper annular frustoconical bearing surface or upon application of such lower axial force on said lower annular frustoconical bearing surface causing the angle of taper of said bearing surfaces to conform to the angle of taper of such compression surfaces.

32. The metal seal ring as defined by claim 31 wherein the angle formed by said upper bearing surface and inner contact surface is 28° and the angle formed by said lower bearing surface and outer contact surface is 28° prior to the application of upper and lower axial forces.

33. The metal seal ring as defined by claims 31 or 32 wherein a first line extending between the intersection of said upper bearing surface and inner contact surface and the intersection of said lower bearing surface and outer contact surface and a second line extending from the intersection of said upper bearing surface and outer contact surface and being perpendicular to said outer contact surface form an angle of between 17° and 20° prior to the application of upper and lower axial forces.

34. A wellhead sealing apparatus comprising:

a wellhead supporting a pipe hanger within the well and having an upper downwardly facing frustoconical shoulder and a first and a second lower upwardly facing frustoconical shoulder, said second shoulder being spaced downwardly and inwardly from said first shoulder;

said pipe hanger having a lower downwardly facing frustoconical shoulder disposed above said second lower wellhead shoulder and below said first lower wellhead shoulder and an upper upwardly facing frustoconical shoulder disposed below said upper wellhead shoulder, said lower pipe hanger shoulder and second lower wellhand shoulder tapering in the same direction and said upper pipe hanger shoulder and upper wellhead shoulder tapering in the same direction;

a first sealing assembly disposed between said upper wellhead shoulder and upper pipe hanger shoulder for sealing the annulus between said pipe hanger and wellhead from borehole pressure;

a second sealing assembly disposed between said second lower wellhead shoulder and lower pipe hanger shoulder for sealing said annulus from downhole annulus pressure;

said pipe hanger also having a lower suspension shoulder disposed on said hanger above said first lower wellhead shoulder for suspending said pipe hanger therefrom;

said first and second sealing assemblies each including a metal seal ring of diamond shaped cross section and a support ring adjacent to said metal seal ring between said upper wellhead shoulder and said metal seal ring of said first sealing assembly and between said second lower wellhead shoulder and said metal seal ring of said second sealing assembly, said support rings having means for limiting the preload that can be applied to said metal seal rings.

35. Well assembly comprising:

a first string of pipe, a first well head means connected to the upper end of said first string of pipe, a second well head means surmounting the first well head, a second string of pipe within the first string of pipe and suspended from the second well head means forming an annulus between said strings of pipe, and double acting seal means between said second string of pipe and said second well head sealing against upward pressure of fluid in said annulus between said strings of pipe and against downward pressure of fluid in said second string of pipe carried over the upper end of said second string of pipe within said second well head means, said second well head means being provided with upwardly flaring conical support means and extending upwardly from said support means having a cylindrical inner peripheral portion, said second pipe string having a cylindrical outer peripheral portion extending upwardly from said support means and forming therewith and with said cylindrical inner cylindrical portion an annular seal pocket, annular seal means in said pocket, an upper compression ring above said seal means axially slidable in said pocket and having an upwardly flaring conical lower surface forming with said pocket a seal chamber, annularly disposed downwardly facing shoulder means on said second string of pipe resting on said compression ring, thereby suspending said second string of pipe as aforesaid, a seal ring in said pocket having bottom, top, and inner and outer peripheral surfaces correlative to those of said seal chamber and fitting closely but axially slidably therewithin, said seal ring being made of elastic, high tensile strength metal, i.e. mild steel, adapted to compress elastically inwardly into sealing engagement with said outer cylindrical peripheral portion and to first stretch elastically and then ductily outwardly into sealing engagement with said inner peripheral surface of said well head means under the pressure of fluid acting downwardly thereon from within said second string of pipe and also under the pressure of fluid acting upwardly thereon from within said annulus, and to retract elastically from said peripheral portions toward its original position when such pressure is removed.

* * * * *